US005362022A

United States Patent [19]

McLoughlin et al.

[11] Patent Number: 5,362,022

[45] Date of Patent: Nov. 8, 1994

[54] AIR TANK BRACKET WITH STRAP-LIFTING ARMS

[76] Inventors: John E. McLoughlin, 26 Southern Blvd., Nesconset, N.Y. 11767; Neocles G. Athanasiades, 6 Maybeck Dr., East Setauket, N.Y. 11733

[21] Appl. No.: 83,558

[22] Filed: Jun. 30, 1993

[51] Int. Cl.[5] ..... A47K 1/08

[52] U.S. Cl. ..... 248/313; 224/211; 224/262; 248/311.3

[58] Field of Search ..... 248/313, 311.3, 316.1, 248/316.7, 309.1, 291, 293, 284, 154; 224/211, 215, 210, 261, 262

[56] References Cited

U.S. PATENT DOCUMENTS

| | | | |
|---|---|---|---|
| 3,191,828 | 6/1965 | Senne | 224/211 |
| 3,547,391 | 12/1970 | Johnson | 248/311.3 |
| 3,603,550 | 9/1971 | Byrd | 248/313 |
| 4,049,164 | 9/1977 | Sullivan et al. | 248/313 X |
| 4,832,299 | 5/1989 | Gorton et al. | 248/291 X |
| 4,848,714 | 7/1989 | Ziaylek, Jr. et al. | 248/313 |
| 5,098,054 | 3/1992 | Dyer | 248/313 |

*Primary Examiner*—Ramon O. Ramirez
*Attorney, Agent, or Firm*—Louise S. Heim

[57] ABSTRACT

An air tank bracket comprises a pair of resilient, C-shaped clips projecting from an elongate, vertically mounted backplate. A footplate for supporting the neck of an air tank extends from the bottom end of the back plate. A horizontally extending cross bar is secured proximate the upper end of the backplate. An arm, preferably of resilient material, is mounted for pivoting movement at each end of the cross bar. Friction pads or the like are provided to maintain the arms in a raised position once they have been lifted. The free end of each arm includes a slit for receiving one of the shoulder straps of the air tank. When the arms are lifted, the shoulder straps are held in a ready-to-wear position.

7 Claims, 2 Drawing Sheets

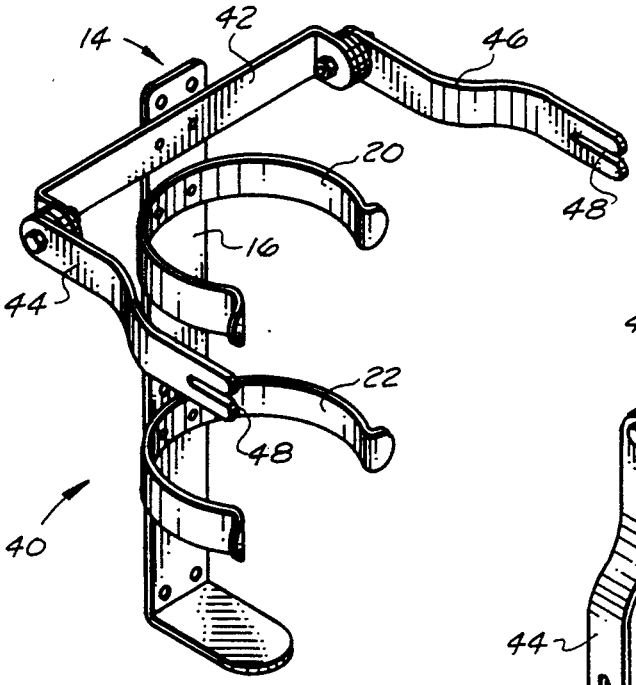
FIG. 3
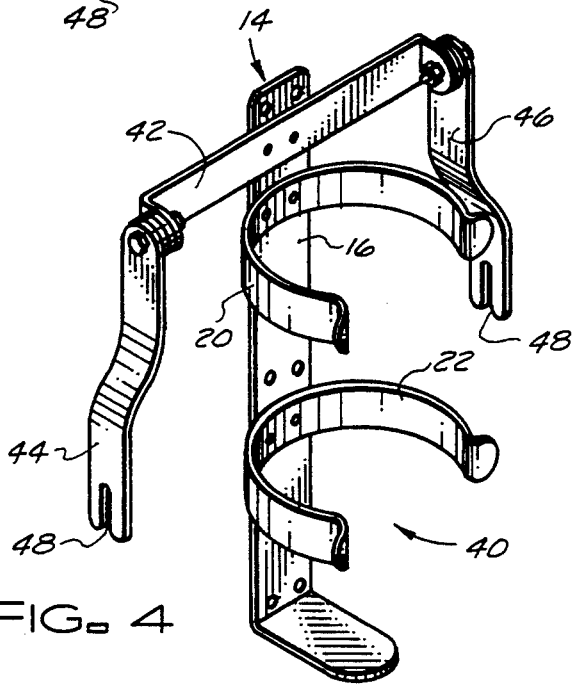
FIG. 4
FIG. 5
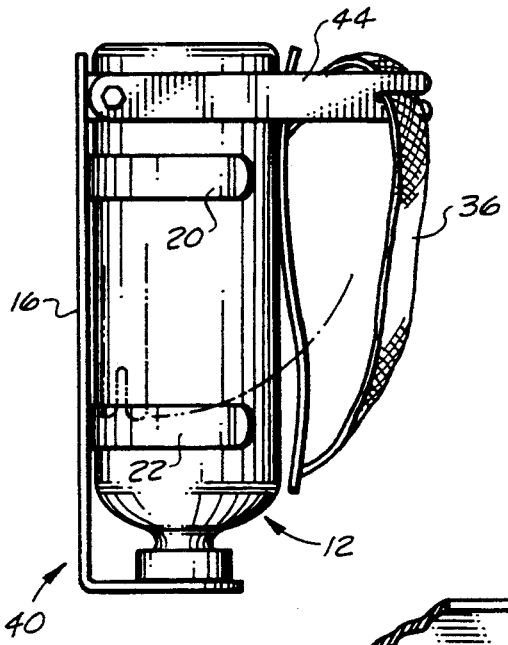
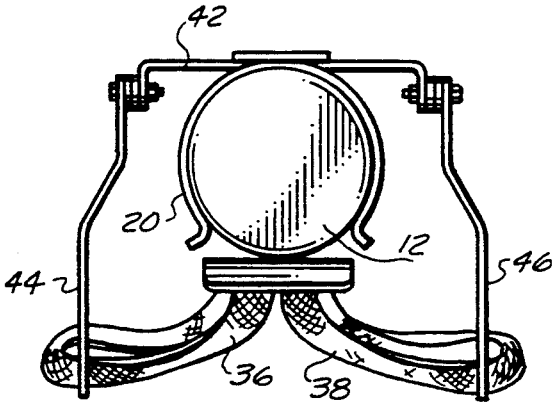
FIG. 6
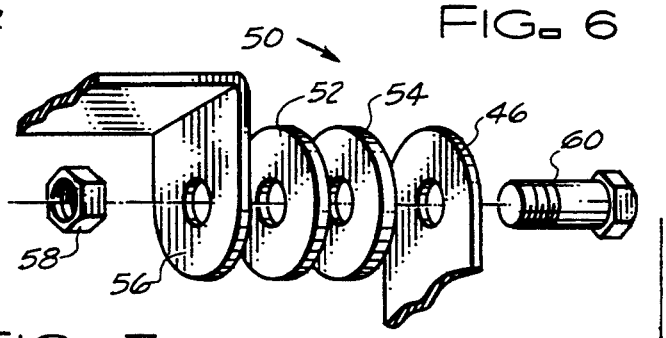
FIG. 7

AIR TANK BRACKET WITH STRAP-LIFTING ARMS

BACKGROUND OF THE INVENTION

Field of the Invention

This invention relates to the art of brackets and holding devices.

More particularly, this invention relates to a bracket for holding a firefighter's air tank.

In a further and more specific aspect, the instant invention concerns an air tank bracket having means for raising the shoulder straps of the air tank, making it easier for a firefighter to don the tank.

Description of the Prior Art

It is standard procedure to outfit a firefighter or other rescue worker with a breathing apparatus allowing him to breathe normally in a smoke-filled building. A typical breathing apparatus consists of a cylindrical air tank or bottle coupled to a face mask, which the firefighter places over his nose and eyes when needed. Shoulder straps, and sometimes a hip harness, are provided on the tank so that the apparatus may be conveniently carried on the firefighter's back.

When not in use, the breathing apparatus is conventionally stored in a bracket permanently mounted on a fire truck. The simplest type of bracket consists merely of a pair of C-shaped clips extending from an elongated backplate, with a footplate extending from the lower end of the backplate to support the neck of the air tank. To don the apparatus, the firefighter places his back against the air tank and pulls the shoulder straps, which normally hang limply from the tank, over his shoulders. This is a rather difficult procedure, especially when the firefighter is clothed in several layers of heavy, protective clothing, and it can result in a loss of valuable time.

Various improvements have been made to conventional air tank brackets to make it easier for a firefighter to put on an air tank in a shorter period of time. However, most of the improvements to date have centered around making the height or position of the bracket adjustable by, for instance, adding swivels or retraction mechanisms. None, to the best of our knowledge, have addressed the issue of making the tank's shoulder straps easier to slip into.

Accordingly, it is an object of the present invention to provide an improved air tank bracket with means for raising the straps of the air tank to an easily donned position.

Another object of the invention is a provision of a bracket, according to the foregoing, which is relatively inexpensive to manufacture and comparatively simple and easy to use.

SUMMARY OF THE INVENTION

Briefly, to achieve the desired objects of the instant invention in accordance with the preferred embodiment thereof, an air tank bracket is provided with a pair of pivoting arms for raising the shoulder straps of the tank to a ready-to-wear position.

More specifically, the bracket comprises a pair of resilient, C-shaped clips projecting from an elongate, vertically mounted backplate. A footplate for supporting the neck of an air tank extends from the bottom end of the back plate. A horizontally extending cross bar is secured proximate the upper end of the backplate. An arm, preferably of resilient material, is mounted for pivoting movement at each end of the cross bar. Retaining means, such as a friction mechanism, are provided to maintain the arms in a raised position once they have been lifted. The free end of each arm includes a slit for receiving one of the shoulder straps of the air tank.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 3 is a perspective view showing the bracket of the present invention, with the strap-holding arms in a raised position;

FIG. 4 is a perspective view similar to FIG. 3, showing the strap-holding arms in a lowered position;

FIG. 5 is a side view showing a tank mounted in the bracket of the present invention, with the strap-holding arms in a raised position;

FIG. 6 is a top view of tank and bracket shown in FIG. 5; and

FIG. 7 is an enlarged, exploded fragmentary view showing a retaining mechanism for maintaining the arms of the bracket in a raised position.

DETAILED DESCRIPTION OF THE PREFERRED EMBODIMENT

Figure 1:
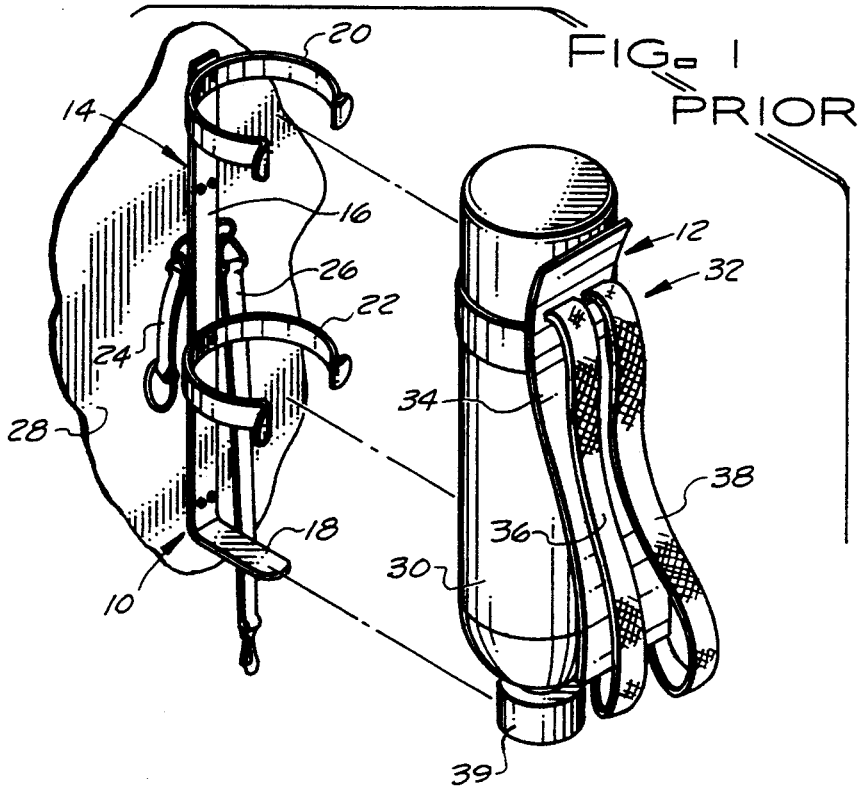
FIG. 1 PRIOR ART
FIG. 1 is a perspective view showing an air tank in exploded relationship to a prior art bracket.

Turning now to the drawings in which like reference characters indicate corresponding elements throughout the several views, attention is first directed to FIG. 1, which shows a prior art mounting bracket 10 and air tank 12. The bracket 10 comprises a base member 14, including an elongate backplate 16 and a footplate 18, and a pair of resilient, C-shaped clips 20, 22 which extend outwardly from the backplate 16. A pair of auxiliary fastening straps 24, 26 are also secured to the backplate 16. The base member 14 is permanently secured to a rigid structure 28, such as the wall of a fire truck.

The air tank 12 comprises a cylindrical bottle 30 mounted in a harness 32 consisting of a back support 34 and shoulder straps 36, 38. An air mask (not shown) is typically coupled to the neck 39 of the bottle 30. A hip harness and other features could also be included.

The tank 12 is mounted neck-down in the bracket 10 with the shoulder straps 36, 38 facing outwardly. To don the tank 12, a firefighter or rescue worker puts his back against the harness 32 and threads his arms through the shoulder straps 36, 38. However, because the straps 36 are relatively close together and hang down loosely, as can be seen in the drawing, this task is rather cumbersome.

Figure 2:
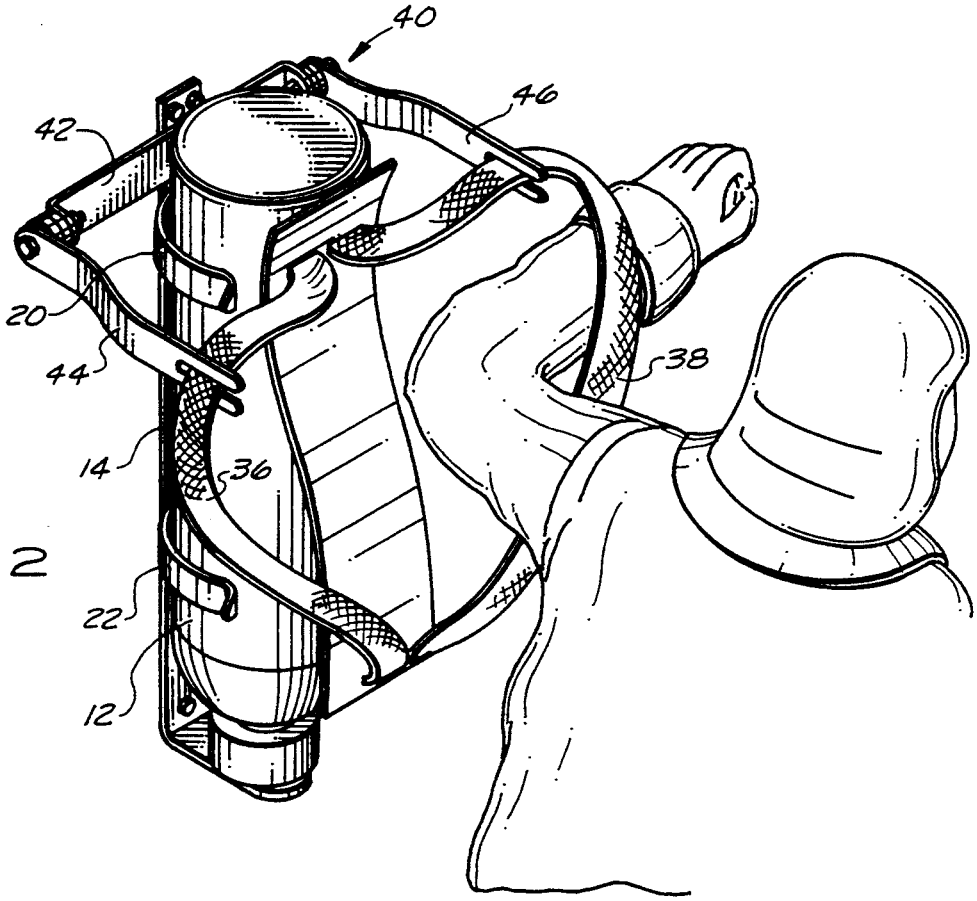
FIG. 2 is a perspective view showing an air tank mounted in the bracket of the present invention.

The present invention overcomes the foregoing problem by providing a bracket 40 with means for raising the straps 36, 38 of the tank 12 to a ready-to-wear position, as illustrated in FIG. 2.

With additional reference to FIGS. 3–6, The bracket 40 comprises a base member 14 and C-Clips 20, 22 which are similar to their counterparts in the prior art bracket 10, except that a horizontally extending cross-bar 42 has been added at the top end of the backplate 16. A pair of arms 44, 46 is provided at opposite ends of the cross-bar 42. The arms 44, 46 are mounted for pivoting movement from a lowered position generally parallel to the base member 14, as seen in FIG. 4, to a raised position generally perpendicular to the base member 14, as seen in FIG. 3. The free end of each arm 44, 46 includes a slit 48 for receiving one of the shoulder straps 36, 38. The arms 44, 46 are preferably made of a resilient material such as spring steel, rubber or plastic, which allows them to be flexed inwardly for compact storage when not in use.

Other grasping means, such as "VELCRO" loops, could be provided at the free end of the arms 44, 46, in lieu of the slit 48. Alternatively, compression springs could be placed at the ends of the arms, with the straps clamped between adjacent coils of the springs.

FIG. 7 shows a retaining, or braking, mechanism 50 for maintaining the arms in the raised position after they have been lifted. A pair of friction pads 52, 54 are interposed between an ear 56 at each end of the cross-bar 42 and the adjacent end of each arm 44, 46. The assembly is held together by a nut 58 and bolt 60. The frictional forces between the pads 52 and 54 are great enough to prevent either arm 44, 46 from rotating around the bolt 60 to a lovered position, unless a force greater than gravity is applied.

Other retaining means for maintaining the arms in the raised position could also be used. For instance, springs could be used to bias the arms to the raised position, with some type of hook or latch provided to hold the arms in the lovered position, against the bias of the springs, when the arms are not in use. Alternatively, a ratchet mechanism could also be used.

Various other modifications and variations to the embodiments herein chosen for purposes of illustration will readily occur to those skilled in the art. To the extent that such variations and modifications do not depart from the spirit of the invention, they are intended to be included within the scope thereof which is assessed only by a fair interpretation of the following claims.

Having fully described and disclosed the instant invention and alternately preferred embodiments thereof in such clear and concise terms as to enable those skilled in the art to understand and practice the same, the invention claimed is:

1. A bracket for supporting a body-carried device having a pair of shoulder straps, the bracket comprising:

a) a base member for attachment to a suitable surface;

b) clip means extending from said base member for holding the device in an accessible position; and c) strap grasping means extending from said base for holding the shoulder straps of the device in a ready-to-wear position, said strap grasping means comprising a pair of arms mounted for pivoting movement from a lowered position generally parallel to said base member to a raised position generally perpendicular to said base member.

2. A bracket according to claim 1, wherein:

a) the body-carried device comprises a cylindrical container; and b) said clip means comprises at least one resilient, C-shaped clip for partially encircling the container.

3. A bracket according to claim 1, further comprising retaining means for holding the arms in the raised position.

4. A bracket according to claim 3, wherein said retaining means comprises a braking mechanism interposed between each of said arms and said base member.

5. A bracket according to claim 4, wherein said braking mechanism comprises a pair of cooperating friction pads interposed between each of said arms and said base member.

6. A bracket according to claim 2, wherein said clip means comprises a pair of longitudinally spaced apart clips.

7. A bracket for supporting a body-carried device having a pair of shoulder straps, the bracket comprising:

a) a base member for attachment to a suitable surface;

b) clip means extending from said base member for holding the device in an accessible position; and c) strap grasping means extending from said base for holding the shoulder straps of the device in a ready-to-wear position, said strap grasping means comprising a pair of elongated arms, each arm having a first end pivotably secured to said base member and a second end including a slit for receiving a shoulder strap.

* * * * *